US008568137B2

(12) United States Patent
Borrel

(10) Patent No.: US 8,568,137 B2
(45) Date of Patent: Oct. 29, 2013

(54) METHOD FOR OPERATING A CONTINUOUS ANNEALING OR GALVANIZATION LINE FOR A METAL STRIP

(75) Inventor: Pierre-Jérôme Borrel, Saint Chamond (FR)

(73) Assignee: Siemens VAI Metals Technologies SAS, Saint Chamond (FR)

( * ) Notice: Subject to any disclaimer, the term of this patent is extended or adjusted under 35 U.S.C. 154(b) by 922 days.

(21) Appl. No.: 12/673,822

(22) PCT Filed: Jul. 4, 2008

(86) PCT No.: PCT/FR2008/000982
§ 371 (c)(1),
(2), (4) Date: Feb. 17, 2010

(87) PCT Pub. No.: WO2009/027593
PCT Pub. Date: Mar. 5, 2009

(65) Prior Publication Data

US 2011/0053107 A1 Mar. 3, 2011

(30) Foreign Application Priority Data

Aug. 31, 2007 (FR) ..... 07 57297

(51) Int. Cl.
*F27B 9/28* (2006.01)

(52) U.S. Cl.
USPC ..... 432/8; 148/601

(58) Field of Classification Search
USPC ..... 432/8, 9, 59, 128; 427/434.2, 434.6; 148/601, 602
See application file for complete search history.

(56) References Cited

U.S. PATENT DOCUMENTS 3,320,085 A 5/1967 Turner, Jr.
3,721,520 A * 3/1973 Bloom ..... 432/143
(Continued)

FOREIGN PATENT DOCUMENTS

FR 2 046 595 A5 3/1971
FR 2 785 668 A1 5/2000
(Continued)

OTHER PUBLICATIONS

J. Faderl et al., "Le système de VAI pour le contrôle du recuit après zingage: la technologie, les résultats, les avantages", Le Revue de Métallurgie-CIT, Jan. 1999, XP-000824007, pp. 67-79.

*Primary Examiner* — Gregory A Wilson
(74) *Attorney, Agent, or Firm* — Laurence A. Greenberg; Werner H. Stemer; Ralph E. Locher

(57) ABSTRACT

A method for operating a continuous annealing or galvanizing line for a metal strip, uses a direct flame heating section with an upstream zone and a downstream zone. The direct flame heating section is followed by a radiant tube heating section. The metal strip is indirectly heated in the direct flame heating section. The heating of the metal strip is achieved in the upstream zone by combustion of a mixture of atmospheric air and fuel such that the temperature of the combustion gas is between 1250° C. and 1500° C., preferably close to 1350° C. and in the downstream zone, the heating of the metal strip is achieved by combustion of a superoxygenated substoichiometric mixture of air and fuel such that the temperature of the combustion gas achieved at the end of the upstream zone is maintained until the end of the downstream zone of the direct flame heating section.

12 Claims, 2 Drawing Sheets

(56) References Cited

U.S. PATENT DOCUMENTS

| | | | | |
|---|---|---|---|---|
| 3,936,543 | A | 2/1976 | Byrd et al. | |
| 4,069,008 | A * | 1/1978 | Bloom | 432/8 |
| 4,133,634 | A * | 1/1979 | Wang | 432/2 |
| 6,183,246 | B1 | 2/2001 | Le Goueffiec | |
| 6,217,681 | B1 | 4/2001 | Bazarian et al. | |
| 6,652,681 | B2 | 11/2003 | Delabroy et al. | |
| 2004/0140024 | A1 | 7/2004 | Bockel-Macal et al. | |

FOREIGN PATENT DOCUMENTS

| | | | |
|---|---|---|---|
| FR | 2 824 078 | A1 | 10/2002 |
| JP | 56-149513 | A | 11/1981 |
| JP | 9-263836 | A | 10/1997 |
| JP | 2003-155448 | A | 5/2003 |
| WO | 02/21061 | A1 | 3/2002 |
| WO | 2004/097318 | A2 | 11/2004 |
| WO | 2007/087973 | A2 | 8/2007 |

* cited by examiner

METHOD FOR OPERATING A CONTINUOUS ANNEALING OR GALVANIZATION LINE FOR A METAL STRIP

BACKGROUND OF THE INVENTION

Field of the Invention

The invention relates to a method for operating a continuous annealing or galvanization line for a metal strip.

The cold rolling of steel causes a strain hardening of the steel, which leads to a weakness of steel making difficult, or even impossible, the later forming of the rolled steel strip.

In order to restore the steel ductility, a heat treatment called "recrystallization annealing" is done. The heat treatment of continuous running steel strips is done in furnaces providing with the heating, the soaking and the holding of the steel strip at the required temperature during the required time. The steel strips can be heated in radiant tubes furnaces (RT) or in furnaces comprising a mixed layout of direct flame heating (DFF) and of soaking/holding of the temperature in a radiant tubes furnace.

In continuous annealing, the use of a direct flame furnace section upstream from the radiant tubes sections allows to reduce the time of the warm-up and therefore the total length of the furnace, which eases the proper guiding of the steel strip. Furthermore, the direct flame furnace ensures a good surface cleaning of the steel strip, allowing to cut the degreasing step of the steel strip before annealing.

Such furnaces are also used for the galvanization methods.

For a few applications such as the construction industry, car industry or the domestic electrical appliance industry, a thin layer of zinc or of zinc-based alloy is laid onto the surface of the steel strips, in order to improve the resistance of the steel strips to corrosion. This coating is done in continuous galvanization lines that comprise a furnace, such as described above, aimed at ensuring the annealing of the steel strip and at its proper temperature setting before the galvanization operation.

At the exit of the furnace, the steel strip must be without any trace of surface oxidation so that the alloying is done properly with the molten alloy.

According to their principle, the direct flame furnaces ensure the air burning of fuels such as natural gasses or fuel-oils. The heating of the steel strip is ensured both by radiation and by convection when exposed to the burnt gasses or combustion gasses.

The maximum temperature of the burnt gasses is normally obtained in the stoichiometric conditions, that is without excess air, nor fuel. An excess air leads to the presence of free oxygen able to oxidize the strip surface. An excess fuel on the contrary releases carbon monoxide and hydrogen that are reducing agents.

The ability of the furnace atmosphere to oxidize or to reduce the surface of the steel strip, at a certain burnt gasses temperature, varies with the percentage of available reducing agents ($CO+H_2$).

U.S. Pat. No. 3,320,085 teaches us that it is possible to maintain in the direct flame furnaces contents of ($CO+H_2$) around 3% to 6%, in order to ensure an end of heating of the steel strip in reducing conditions.

In the direct flame furnaces, the ratio air/fuel decreases all along the furnace by progressive fuel enrichment. This leads to a decrease of the burnt gasses temperature towards the exit of the furnace. The maximum burnt gasses temperatures usually reached in stoichiometric conditions are in the region of 1400° C., in order to maintain a temperature around 1300° C., by the walls refractories.

In furnace full capacity working conditions, the maximum burnt gasses temperature can go more than 100° C. down in the last sections of the furnace, which leads to a smaller furnace working capacity. This temperature decrease involves an end of heating of the steel strip in non-reducing conditions.

Secondly, this decrease of the combustion efficiency and thus of the direct flame furnace heating capacities requires the use of a radiant tubes furnace, at the exit of the direct flame furnace, having a greater capacity. Therefore it is important to optimize the direct flame furnace combustion.

It has been said, in document U.S. Pat. No. 3,936,543, to use stoichiometric air/gas ratios or ratios with a slight excess air in order to improve the combustion efficiency by elimination of unburnt gasses and to increase the direct flame furnace heating capacity.

In such slightly oxidizing conditions, a thin oxides layer is forming on the steel strip surface. Theses oxides are then reduced in heating sections of temperature holding, placed in an atmosphere composed of a mixture of at least 5% reducing hydrogen and of nitrogen.

Another efficient and simple way of improving the combustion consists in pre-heating the air before combustion. This solution, alone, cannot however be retained because it increases the release of nitrogen oxides (NOx) with the use of conventional burners.

Finally, from document U.S. Pat. No. 6,217,681 is known a combustion method called "Oxy-fuel", consisting in ensuring the combustion in pure oxygen. This method allows to considerably increase the furnace efficiency. However, this solution presents the drawback of an important oxygen cost.

BRIEF SUMMARY OF THE INVENTION

The purpose of the invention consists in describing a heat treatment method of a metal strip allowing to increase the heating capacity and the efficiency of the direct flame furnace.

To that end, the invention concerns a method for operating a continuous annealing or galvanization line for a metal strip, comprising a direct flame heating section made up of an upstream zone and of a downstream zone, the direct flame heating section being followed by a radiant tubes heating section, and the metal strip being indirectly heated by the flame in the direct flame heating section.

According to the invention:

- in the upstream zone, the metal strip heating is obtained by combustion of an atmospheric air and fuel mixture such that the combustion gasses temperature is between 1250° C. and 1500° C., preferably around 1350° C., and
- in the downstream zone, the metal strip heating is obtained by combustion of an understoichiometric mixture of air and of oxygen enriched fuel such that the combustion gasses temperature reached at the end of the upstream zone is maintained until the end of the downstream zone of the direct flame heating section.

It is meant by "understoichiometric mixture of air and of oxygen enriched fuel" a mixture comprising a slight excess fuel.

It is meant by "combustion gasses", gasses stemming from the combustion, that is the burnt or unburnt gasses.

In different possible embodiments, the present invention relates also to the following characteristics that can be considered separately or according to all their technically possible combinations and provide, each of them, specific advantages:

- the oxygen enrichment of the air and fuel mixture is obtained by an oxygen enrichment of the atmospheric air,
- the oxygen enrichment of the air and fuel mixture is obtained by an oxygenation of the fuel,
- the rate of oxygen enrichment of the mixture of air and of fuel is between 1% and 15%, preferentially between 1% and 7% in volume in comparison with the average rate of oxygen contained in the atmospheric air,
- in the direct flame heating section, the percentage in volume of unburnt gasses ($CO+H_2$) is smaller than 6%, in comparison with the combustion gasses volume, preferably between 4% and 6%,
- the rate of oxygen enrichment is increasing all along the direct flame heating section,
- the downstream zone of the direct flame heating section consists approximately in half of a direct flame heating section,
- the direct flame heating section is preceded by a pre-heating section for the metal strip, the pre-heating of the metal strip being obtained by the combustion gasses stemming from said direct flame heating section,
- the direct flame heating section is followed by a radiant tubes heating section, the temperature of the metal strip being able to exceed 800° C. at the entrance of the radiant tubes heating section,
- the oxygen necessary for the oxygen enrichment of the combustion air in the downstream zone of the direct flame heating section is a by-product stemming from an air separation method to the purpose of producing nitrogen.

The method for operating a continuous annealing or galvanization line for a metal strip, according to the invention, allows to increase the heating and production capacity of direct flame furnaces while keeping the usual air/fuel ratios and staying within controlled oxidizing/reducing conditions. This method is called "SUROX" method.

It is meant by air/fuel "ratio" or "rate", the mass ratio between the air and the fuel.

The metal strip temperature is higher at the exit of the direct flame furnace, which allows to improve the cleaning of the metal strip.

The fuel consumption decreases.

Moreover, the environmental impact is improved by reduction of NOx.

The method for operating a continuous annealing or galvanization line for a metal strip, according to the invention, is compatible with the existing direct flame furnaces. In fact, the burnt gasses temperature is compatible with the one of the refractories from the furnace walls. It is not necessary to change the refractory composition, which allows to easily modify, and without production shutdown, all the facilities equipped with direct flame furnaces.

The operating for the "SUROX" method, according to the invention, is much more sparing than the "OXY-FUEL" methods, of the prior art, which require a large quantity of oxygen.

BRIEF DESCRIPTION OF THE SEVERAL VIEWS OF THE DRAWING

The invention will be described in more details by reference to the annexed drawings wherein.

DESCRIPTION OF THE INVENTION

The continuous annealing or galvanization line for a metal strip, according to the invention, comprises a direct flame heating section 9. This direct flame heating section 9 comprises an upstream zone 10 and a downstream zone 11. The "upstream" and "downstream" terms are defined in comparison with the progress direction of the metal strip in the direct flame heating section 9. This way, during the progress of the metal strip in the direct flame heating section 9, said strip goes across the upstream zone 10, then the downstream zone 11. The limit between the upstream and the downstream zones is at the burnt gasses maximum temperature reached during combustion in atmospheric air.

The direct flame heating section 9 of the furnace comprises a plurality of burners. The burners are placed inside the furnace and dispatched along it.

The metal strip is heated in the direct flame furnace by direct combustion of a fuel and of combustion air (atmospheric air) inside the furnace, producing combustion gasses (or burnt gasses) heating the metal strip by convection and by radiation. The metal strip is indirectly heated by the flame in the direct flame heating section 9. In other words, the metal strip is not in direct contact with the flame of the burners in the direct flame heating section 9.

The direct flame heating section 9 of the furnace can be preceded by a pre-heating section for the metal strip. The pre-heating of the metal strip is obtained by the combustion gasses stemming from the direct flame heating section 9.

Figure 1:
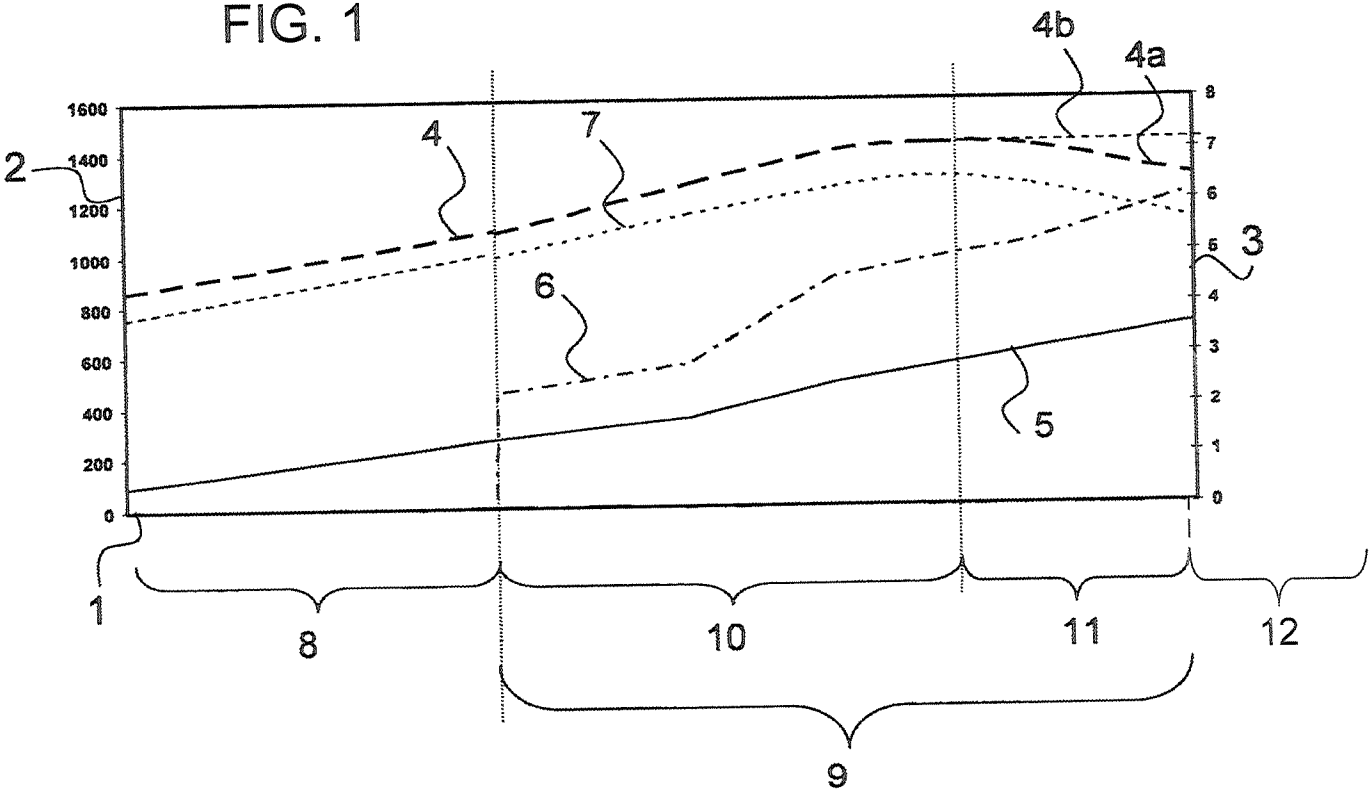
FIG. 1 represents the distribution of the temperatures and of the unburnt gasses percentage according to the progress of the metal strip in the pre-heating section and in the direct flame heating section.

FIG. 1 represents the distribution of the temperatures and of the percentage of unburnt gasses according to the progress of the metal strip in the pre-heating section 8 and in the direct flame heating section 9.

The values of the example of FIG. 1 and of table 1 are given for a steel strip 1500 mm wide and for a direct flame furnace comprising four heating zones. Each heating zone has a power of 3,250,000 Kcal/h. Such a direct flame furnace is able to continuously heat 60 tons per hour of steel strip at 680° C.

The abscissa axis 1 represents the different sections the metal strip is going across. The ordinate axis 2, located on the left of FIG. 1, represents the temperature in ° C. of the metal strip, of the combustion gasses and of the furnaces walls. The ordinate axis 3, located on the right of FIG. 1, represents the percentage in volume of unburnt gasses ($CO+H_2$), in comparison with the volume of combustion gasses.

Curve 4 represents the combustion gasses temperature according to sections the metal strip is going across. It shows that during the metal strip pre-heating step in the pre-heating section 8, the combustion gasses temperature is about 1000° C., and that it increases progressively according to the progress of the metal strip in the heating section 9, up to reaching a maximum value around 1400° C. at the exit of the upstream zone 10 of the heating section 9.

Generally, the combustion gasses temperature can be between 1350° C. and 1500° C. at the exit of the upstream zone 10 of the heating section 9.

Curve 5 represents the metal strip temperature according to the sections said strip is going across.

The metal strip temperature progressively increases in the heating section 9 up to reaching a value around 700° C., at the exit of the heating section 9.

Curve 6 represents the percentage of unburnt gasses ($CO+H_2$) according to the sections the metal strip is going across.

The percentage of unburnt gasses ($CO+H_2$) progressively increases in the heating section 9. In the example of FIG. 1, it is around 4.5% in volume in comparison with the volume of combustion gasses. It then increases rather quickly on reaching the end of the upstream zone 10 and especially in the downstream zone 11 of the heating section 9 at the exit of which it can reach more than 6% in volume in comparison with the volume of combustion gasses.

The temperature variations of the pre-heating furnace walls, represented by curve 7, follow the ones of the combustion gasses, the temperature of the pre-heating furnace walls staying lower than the one of the combustion gasses.

As previously said, the direct flame heating section 9 comprises an upstream zone 10. The combustion gasses temperature progressively increases in the upstream zone 10 up to reaching at its exit, a value around 1350° C. to 1450° C.

Table 1, below, gives values of combustion gasses temperature, of metal strip temperature and of air/fuel ratio for direct flame heating sections of continuous annealing or galvanization line for a metal strip.

TABLE 1

| | | | | Direct flame heating section | | | |
|---|---|---|---|---|---|---|---|
| | | | | Upstream zone | | Downstream zone | |
| | Pre-heating section | | | Zone 1 | Zone 2 | Zone 3 | Zone 4 |
| Air/fuel ratio | | | | 1.02 | 0.95 | 0.92 | 0.85 |
| Strip temperature | 120° C. | 120° C. | 310° C. | 415° C. | 510° C. | 600° C. | 680° C. |
| Gasses temperature | | 1260° C. | | 1380° C. | 1404° C. | 1354° C. | 1326° C. |

In this example, the upstream zone 10 and the downstream zone 11 comprise two zones each.

In the first zone (zone 1) of the upstream zone 10, the combustion gasses temperature is 1380° C. and the one of the metal strip is 415° C. for an air/fuel ratio of 1.02.

In the second zone (zone 2) of the upstream zone 10, the combustion gasses temperature is 1404° C. and the one of the metal strip is 510° C. for an air/fuel ratio of 0.95.

In the upstream zone 10, the temperature of the combustion gasses and of the metal strip progressively increases, as illustrated on FIG. 1 by respective curves 4 and 5. As for the air/fuel ratio, it decreases because of an increasing supply of fuel in the air/fuel mixture according to the progress of the metal strip in the upstream zone 10. This increasing supply of fuel contributes to an increase of the percentage of unburnt gasses ($CO+H_2$), which increases up to around 5.1% in volume, in comparison with the combustion gasses volume, at the end of the upstream zone 10. The oxygen percentage in the combustion air supplying the burners of the upstream zone 10 is around 20.8% in volume, which corresponds to the average oxygen percentage in the atmospheric air.

In the example above, the downstream zone 11 of the direct flame heating section 9 is also made up of two zones of which a first zone (zone 3), located after the second zone (zone 2) of the upstream zone 10, and a second zone (zone 4) located between the first zone (zone 3) of the downstream zone 11 and the exit of the direct flame heating section 9.

This example is not restrictive and the number of zones can vary in the upstream and downstream zones.

On FIG. 1, curve section 4*a* of curve 4 represents the evolution of the combustion gasses temperature in the downstream zone 11, according to the prior art.

This curve section 4*a* shows that the combustion gasses temperature decreases in the downstream zone 11 up to a value being around 1250° C. to 1350° C. This decrease of the combustion gasses temperature leads to a decrease of the heating speed of the metal strip. The metal strip temperature is between 650° C. and 700° C. at the exit of the downstream zone 11. As for the percentage of unburnt gasses ($CO+H_2$), it increases to around 6.2% in volume in comparison with the volume of combustion gasses.

In the example of table 1, the combustion gasses temperature is 1354° C. and the one of the metal strip is 600° C. for an air/fuel ratio of 0.92, in the first zone (zone 3) of the downstream zone 11.

In the second zone (zone 4) of the downstream zone 11, the combustion gasses temperature is 1326° C. and the one of the metal strip is only reaching 680° C. for an air/fuel ratio of 0.85. The heating capacity of the direct flame furnace is smaller in the downstream zone 11 than in the upstream zone 10.

The direct flame heating section 9 is usually followed by a radiant tubes heating section 12 in neutral atmosphere, comprising nitrogen. The metal strip temperature, between 650° C. and 700° C., is then insufficient and imposes the going on of the heating in the radiant tubes furnace section that is required to have an important capacity, which increases the facility cost and aggravates the metal strip guiding problems along such big distance.

Figure 2:
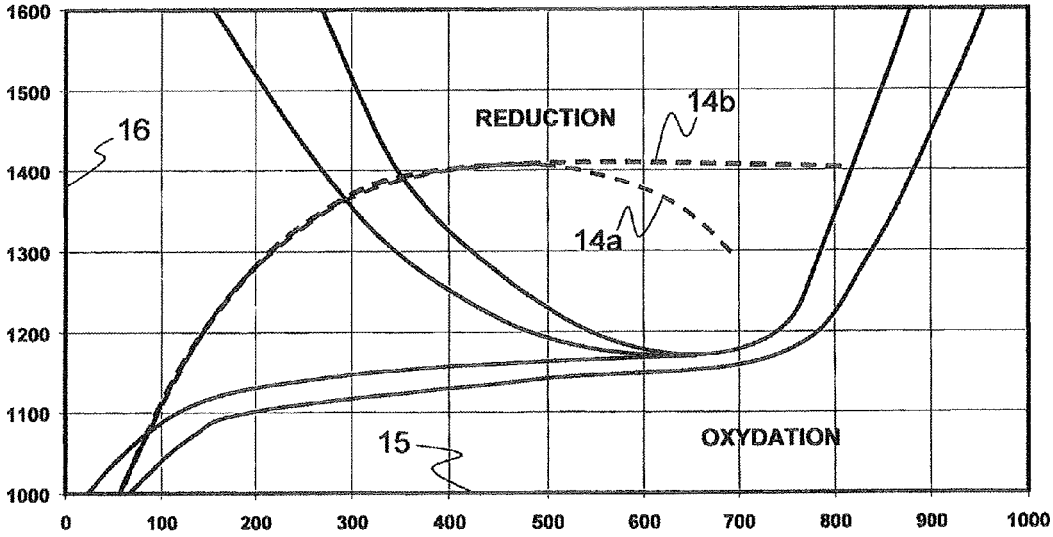
FIG. 2 represents an oxidizing/reducing graph wherein the combustion gasses temperature is correlated to the one of the metal strip.

Moreover, at these temperatures, the reducing conditions limit of the metal strip surface can be neared, as FIG. 2 shows it.

FIG. 2 illustrates an oxidizing/reducing graph on which are represented 14*a* and 14*b* curves corresponding to the correlative evolution of the combustion gasses temperature and of the one of the metal strip, respectively according to the prior art and to the invention.

This example is given for a soft steel strip in a direct flame furnace with an atmosphere comprising 4% to 6% of unburnt gasses ($CO+H_2$) in volume in comparison with the combustion gasses volume.

The abscissa axis 15 represents the metal strip temperature in ° C. and the ordinate axis 16 represents the combustion gasses temperature in ° C.

The oxidizing/reducing graph of FIG. 2 shows that when the combustion gasses temperature is lower than around 1000° C., oxidizing conditions of the metal strip surface are met.

Curve 14*a* representing the correlative evolution of the combustion gasses temperature and of the one of the metal strip, according to the prior art, shows that the reducing zone limits are reached when the combustion gasses temperature decreases up to around 1300° C. and when the one of the metal strip is around 690° C.

Pure oxygen is used, as usually supplied on the market. Oxygen can also be advantageously obtained by oxygen separation methods, described further.

Table 2, below, based on data of FIG. 1 and table 1, gives combustion gasses temperature values in the first (zone 3) and second (zone 4) zones of the downstream zone 11 according to the percentage in volume of oxygen in the combustion air.

TABLE 2

| % of $O_2$ in the combustion air (in volume) | Rate of oxygen enrichment | Combustion gasses temperature in ° C. Zone 3 Temperatures with oxygen enrichment | Zone 3 Reminder: without oxygen enrichment | Zone 4 Temperatures with oxygen enrichment | Zone 4 Reminder: without oxygen enrichment |
|---|---|---|---|---|---|
| 20.8 | 0 | 1354 | 1354 | 1326 | 1326 |
| 21.8 | 1 | 1366 | | 1341 | |
| 22.8 | 2 | 1379 | | 1353 | |
| 23.8 | 3 | 1392 | | 1365 | |
| 24.8 | 4 | 1405 | | 1378 | |
| 25.8 | 5 | 1418 | | 1391 | |
| 26.8 | 6 | | | 1404 | |
| 27.8 | 7 | | | 1417 | |

In order to solve this problem, the invention advises to use, during the direct flame heating of the metal strip in the downstream zone 11, a combustion of an understoichiometric mixture of air and of oxygen enriched fuel, such that the combustion gasses temperature reached at the end of the upstream zone 10 is at least maintained up to the end of the downstream zone 11 of the direct flame heating section 9.

The combustion gasses temperature in the downstream zone 11 can vary from plus to minus 10° C. in comparison with the combustion gasses temperature reached at the end of the upstream zone 10.

Compared with the prior art, the combustion gasses temperature in the combustion chamber of the downstream zone 11 of the heating section 9 is higher by using an oxygen enriched air, while maintaining the same conditions of $CO+H_2$ reducing unburnt gasses content.

The downstream zone 11 of the direct flame heating section can approximately correspond to the last half of the direct flame heating section 9. The downstream zone 11 of the direct flame heating section can also correspond to more or less a half of the direct flame heating section 9.

According to an embodiment of the invention, the oxygen enrichment of the air and fuel mixture is obtained by an increase of the percentage in volume of oxygen in the combustion air.

In other words, the rate of oxygen enrichment of the air and fuel mixture can be between 1% and 15% in volume in comparison with the average rate of oxygen contained in the atmospheric air. Preferentially, this rate is limited between 1% and 7% in order not to increase the combustion gasses temperature beyond the existing refractory walls capacities.

The average rate of oxygen contained in the atmospheric air being around 20.8%, the percentage of oxygen in the oxygen enriched combustion air is thus set preferentially between 21.8% and 27.8% in volume.

The oxygen enrichment of the air of the air/fuel mixture allows to decrease the nitrogen quantity of the mixture for the benefit of the oxygen/fuel mixture, without modifying the usual air/fuel ratio which naturally changes along the furnace by building up of the unburnt gasses. In the example given previously, the air/fuel ratio varies around 1 to 0.85. The oxygen enrichment of the air of the air/fuel mixture does not change this evolution of the air/fuel ratio.

It is observed that the combustion gasses temperature is almost identical in the first and second zones (zone 3 and 4) of the downstream zone 11 for a percentage of oxygen in the air between 24.8% and 26.8% in volume, that is to say a rate of oxygen enrichment of the air between 4% and 6% in volume in comparison with the average rate of oxygen contained in the atmospheric air. The combustion gasses temperature is then maintained at around 1400° C.

In the first zone (zone 3) of the downstream zone 11, when the percentage in volume of oxygen in the air varies between 21.8% and 25.8%, the combustion gasses temperature varies between 1366° C. and 1418° C. In other words, the combustion gasses temperature can be maintained at around 1400° C., in the first zone (zone 3) of the downstream zone 11.

In the second zone (zone 4) of the downstream zone 11, when the percentage in volume of oxygen in the air varies between 21.8% and 27.8%, the combustion gasses temperature varies between 1341° C. and 1417° C. In other words, the combustion gasses temperature can be maintained at around 1400° C., in the second zone (zone 4) of the downstream zone 11.

On FIG. 1, the curve section 4*b* of curve 4 represents the change of combustion gasses temperature according to the progress of the metal strip in the downstream zone 11, according to the invention.

In this example, the combustion gasses temperature is maintained at around 1400° C., during the progress of the metal strip in the downstream zone 11. The metal strip temperature increases up to reaching a value able to exceed 800° C. at the exit of the direct flame furnace (not represented on FIG. 1).

Thus, a homogeneous unburnt gasses temperature is obtained that is around 1400° C. all along the downstream zone of the direct flame heating section 9.

Figure 3:
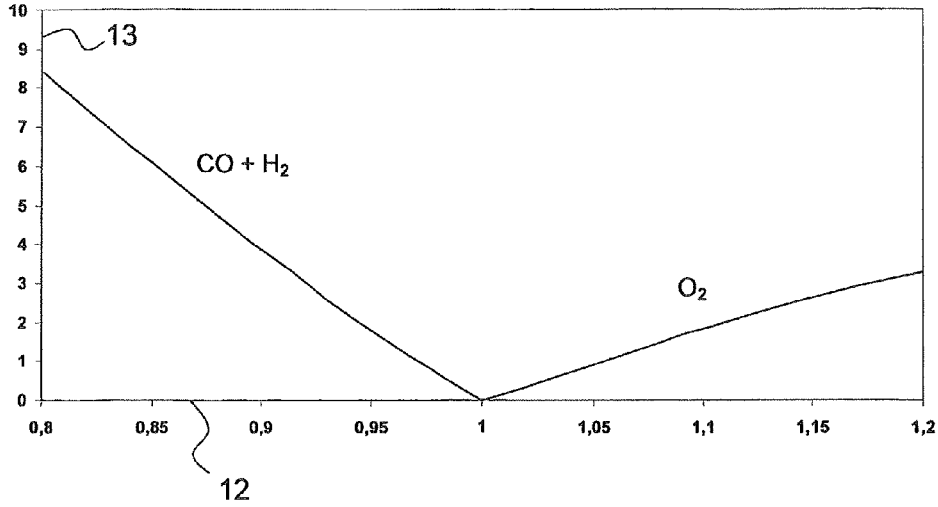
FIG. 3 represents the percentage of unburnt gasses ($CO+H_2$) and of oxygen according to the air/fuel ratio.

In the direct flame heating section 9, the percentage in volume of unburnt gasses ($CO+H_2$) is kept between 4% and 6% in comparison with the volume of combustion gasses, that is to say a fuel/air ratio greater than 0.85, as FIG. 3 shows it.

FIG. 3 represents the percentage of unburnt gasses ($CO+H_2$) and of oxygen according to the air/fuel ratio.

The abscissa axis 12 represents the air/fuel ratio and the ordinate axis 13 represents the percentage of unburnt gasses ($CO+H_2$) and of oxygen.

FIG. 3 shows that an excess air leads to the presence of free oxygen able to oxidize the surface of the metal strip and that an excess fuel releases, on the contrary, carbon monoxide and hydrogen which are reducing.

According to a preferred embodiment of the invention, conditions are advantageously set up so that the atmosphere inside the furnace contains a slight excess of unburnt gasses.

Curve 14*b* of FIG. 2 representing the correlative change of the combustion gasses temperature and of the one of the metal strip, according to the invention, shows that the oxygen enrichment of the air/fuel mixture allows to stay in the reduction conditions, with a homogeneous combustion gasses temperature, that are around 1400° C., and a metal strip temperature able to exceed 800° C. On the whole, all other things being equal, the controlled oxygen enrichment of the combustion air allows to reach strip temperatures higher than the ones obtained during combustion in the atmospheric air.

The oxidation-reduction balances are dependent on the temperature and on the composition of the combustion gasses but also on the strip temperature.

According to another possible embodiment of the invention, the percentage in volume of oxygen in the air is different in the first and second zones. The percentage in volume of oxygen in the air of the second zone of the downstream zone 11 is greater than the one of the first zone of the downstream zone 11. This embodiment allows, more easily and with smaller oxygen consumption, to obtain a homogeneous temperature in the whole direct flame heating section 9.

The oxygen enrichment rate can be growing all along the direct flame heating section 9, a continuous or discontinuous way.

According to another possible embodiment of the invention, the oxygen enrichment of the air and fuel mixture, in the downstream zone 11, is obtained by an oxygen enrichment of the fuel. The fuel is oxygenated before injection in the burners in proportions allowing to stay out of the explosibility range.

Finally, the direct flame heating section 9 of the continuous annealing or galvanization line is followed by a radiant tubes heating section. The metal strip temperature can reach more than 800° C. at the entrance of the radiant tubes heating section, which allows to use a radiant tubes furnace with low or standard heating capacity.

In the case of a continuous annealing line or in the case of a continuous galvanization line, the radiant tubes section has to be continuously fed with nitrogen to ensure the flushing of the furnace atmosphere as well as the drainings of this furnace after each shutdown and before each starting up again.

Nitrogen can be provided by a supply from gas distributors. It can be provided by the steel mill in case of integrated plant because nitrogen is an abundant by-product of oxygen production.

It can be produced on site by combustion and refining (endothermic generator) or by air separation.

The air separation can be realized by "Pressure Swing Adsorption" (PSA) producing oxygen in vapour zone under pressure.

The air separation can be realized by diaphragms producing oxygen in vapour zone under pressure.

Finally, it can be realized by distillation of the liquid air, producing oxygen in liquid phase at 10% and in vapour zone at 90%.

In the air separation methods, nitrogen is produced with purity greater than 99.99%. A by-product jet called "tail gas", rich in oxygen, is rejected in the atmosphere.

In an embodiment of the invention, the oxygen necessary for the oxygen enrichment of the combustion air in the downstream 11 of the direct flame heating section 9 is a by-product stemming from an air separation method aimed at producing nitrogen.

It is possible to salvage this gas very rich in oxygen to use it in the furnaces in order to ensure controlled oxygen enrichment or even an "Oxy-fuel" operation. The oxygen production cost is then almost nil.

As an example, the nitrogen consumption of a galvanization line is around 300 to 1200 $Nm^3/h$ continuously and up to 5000 $Nm^3/h$ during a draining phase. The equivalent oxygen production (in the proportion of around ⅕ of the processed air volume) is more than enough to ensure the furnace partial or full operation in oxygen enrichment, with the double advantage not to be dependent on oxygen deliveries and to decrease the operating costs.

Thus, the method for operating a continuous annealing or galvanization line for a metal strip, according to the invention, allows to increase the heating and production capacity of the direct flame furnaces while keeping the usual air/fuel ratios and while staying within controlled oxidizing/reducing conditions.

The metal strip temperature is higher at the exit of the direct flame furnace, which allows to improve the cleaning of the metal strip.

The consumption of combustion gasses decreases.

Moreover, the environmental impact is improved by reduction of NOx. The method according to the invention provides, for the same air quantity, with a more important oxygen proportion and with a correlative decreasing of the nitrogen quantity.

The method for operating a continuous annealing or galvanization line for a metal strip, according to the invention, is compatible with the existing direct flame furnaces. In fact, the metal strip temperature is compatible with the one of the refractories from the furnace walls. It is not necessary to change the refractory composition, which allows to easily modify, and without production shutdown, all the facilities equipped with direct flame furnaces.

The invention is not limited to continuous annealing or galvanization lines, but can also be generalized to any method including a metal strip heat treatment step.

The operating of the "SUROX" method, according to the invention, is much more sparing than the "OXY-FUEL" methods, of the prior art, which request a large quantity of oxygen.

The invention claimed is:

1. A method for operating a continuous annealing or galvanizing line for a metal strip, the method comprising the following steps:

indirectly heating the metal strip by a flame in a direct flame heating section having an upstream zone and a downstream zone;

carrying out the heating of the metal strip in the upstream zone by combustion of an atmospheric air and fuel mixture to reach a combustion gas temperature at an end of the upstream zone of between 1250° C. and 1500° C.;

carrying out the heating of the metal strip in the downstream zone by combustion of an understoichiometric mixture of air and oxygen-enriched fuel to maintain the combustion gas temperature reached at the end of the upstream zone to an end of the downstream zone; and carrying out an oxygen enrichment of the air and fuel mixture at a rate of between 1% and 15% by volume in comparison with an average rate of oxygen contained in the atmospheric air.

2. The method for operating a continuous annealing or galvanizing line for a metal strip according to claim 1, wherein the combustion gas temperature at the end of the upstream zone is approximately 1350° C.

3. The method for operating a continuous annealing or galvanizing line for a metal strip according to claim 1, which further comprises carrying out an oxygen enrichment of the air and fuel mixture by an oxygen enrichment of the atmospheric air.

4. The method for operating a continuous annealing or galvanizing line for a metal strip according to claim 1, which further comprises carrying out an oxygen enrichment of the air and fuel mixture by an oxygenation of the fuel.

5. The method for operating a continuous annealing or galvanizing line for a metal strip according to claim 1, which further comprises carrying out an oxygen enrichment of the air and fuel mixture at a rate of between 1% and 7% by volume in comparison with an average rate of oxygen contained in the atmospheric air.

6. The method for operating a continuous annealing or galvanizing line for a metal strip according to claim 1, wherein a percentage by volume of unburnt gasses ($CO+H_2$) in the direct flame heating section is smaller than 6% in comparison with a combustion gas volume.

7. The method for operating a continuous annealing or galvanizing line for a metal strip according to claim 1, wherein a percentage by volume of unburnt gasses ($CO+H_2$) in the direct flame heating section is between 4% and 6% in comparison with a combustion gas volume.

8. The method for operating a continuous annealing or galvanizing line for a metal strip according to claim 1, which further comprises increasing a rate of oxygen enrichment all along the direct flame heating section.

9. The method for operating a continuous annealing or galvanizing line for a metal strip according to claim 1, wherein the downstream zone of the direct flame heating section is approximately half of the direct flame heating section.

10. The method for operating a continuous annealing or galvanizing line for a metal strip according to claim 1, which further comprises providing a pre-heating section for the metal strip upstream of the direct flame heating section, and pre-heating the metal strip in the pre-heating section with combustion gasses from the direct flame heating section.

11. The method for operating a continuous annealing or galvanizing line for a metal strip according to claim 1, which further comprises providing a radiant tube heating section downstream of the direct flame heating section, wherein the metal strip has a temperature exceeding 800° C. at an entrance of the radiant tube heating section.

12. The method for operating a continuous annealing or galvanizing line for a metal strip according to claim 1, which further comprises providing oxygen necessary for oxygen enrichment of combustion air in the downstream zone of the direct flame heating section as a by-product of an air separation method for producing nitrogen.

* * * * *